US012422215B1

(12) United States Patent
Kobtsev et al.

(10) Patent No.: US 12,422,215 B1
(45) Date of Patent: Sep. 23, 2025

(54) COMPRESSED GAS SUPPLY DEVICE OF AN AIR RIFLE

(71) Applicants: Dmytro Kobtsev, Krushynka (UA); Maksym Razbudey, Kyiv (UA)

(72) Inventors: Dmytro Kobtsev, Krushynka (UA); Maksym Razbudey, Kyiv (UA)

( * ) Notice: Subject to any disclaimer, the term of this patent is extended or adjusted under 35 U.S.C. 154(b) by 0 days.

(21) Appl. No.: 18/678,797

(22) Filed: May 30, 2024

(51) Int. Cl.
*F41B 11/721* (2013.01)
*F41A 19/10* (2006.01)

(52) U.S. Cl.
CPC ..... *F41B 11/721* (2013.01); *F41A 19/10* (2013.01)

(58) Field of Classification Search
CPC ..... F41B 11/721; F41B 11/72; F41B 11/723; F41B 11/73
See application file for complete search history.

(56) References Cited

U.S. PATENT DOCUMENTS 4,936,282 A * 6/1990 Dobbins ..... F41B 11/723 124/73
9,638,490 B1 * 5/2017 Shen ..... F41B 11/723
11,098,810 B2 8/2021 Gafarov et al.
2016/0363414 A1 * 12/2016 Tseng ..... F41B 11/723
2017/0160046 A1 * 6/2017 Shen ..... F41B 11/642
2021/0293509 A1 9/2021 Plachy

FOREIGN PATENT DOCUMENTS

EP 3 064 884 B1 1/2018

* cited by examiner

*Primary Examiner* — Jonathan C Weber
(74) *Attorney, Agent, or Firm* — SALIWANCHIK, LLOYD & EISENSCHENK

(57) ABSTRACT

A compressed gas supply device of an air rifle provides simultaneously short response time, low gas consumption per shot and automatic cocking. It comprises a pressure chamber formed by a cylindrical body, a first end element and a second end element attached to it communicating with the rifle barrel, a valve and a tie located in the pressure chamber, means for supplying compressed gas to the pressure chamber and a trigger mechanism. The front part of the tie comprises a valve spring, while the valve rests on the valve spring and is capable of moving forward and backward in relation to the tie. In the pressure chamber near the second end element there is a piston and a piston spring on which the piston rests. The piston divides the pressure chamber into the front part located between the first end element and the piston, and the rear part located between the piston and the second end element. The piston being capable of moving forward and backward in relation to the second end element. The piston is made in the form of a cylindrical body and has a center hole.

14 Claims, 10 Drawing Sheets

COMPRESSED GAS SUPPLY DEVICE OF AN AIR RIFLE

FIELD OF THE INVENTION

The invention relates to pre-charged pneumatics (PCP), and more particularly to devices for supplying compressed gas to air rifles.

BACKGROUND OF THE INVENTION

Important characteristics of air rifle gas supply devices are:

1. Response time, that is the time from the moment of pressing the trigger until the bullet starts moving.
2. Gas consumption per shot with the same initial data: rifle caliber, bullet weight and its energy (velocity).
3. Bolt-action or automatic cocking.

U.S. Pat. No. 11,098,810 B2 (hereinafter referred to as "device-1") discloses a rapid response valve device used in an air rifle. It provides automatic cocking. However, it has the following disadvantages (further, when describing the prior art, the numbering of device components used in the cited documents is observed).

The speed of closing the main valve 2 depends on the diameter of the hole 6 through which the control chamber 5 communicates with the pressure chamber 4. If the diameter is made large, the main valve 2 will not be able to open; if the diameter is made too small, the main valve 2 will take a long time to close. That is, the diameter of the hole 6 must be selected for the specific gas pressure in the pressure chamber 4.

The valve mechanism and the barrel are located in different planes, so the exit channel 1 has two bends, which, when firing, a gas flow passes along the path from the pressure chamber 4 to the bullet located in the barrel. This results in the formation of turbulent flow of gas and a loss of a substantial portion of the gas energy intended for the shot. In addition, the exit channel has an increased length, and the compressed gas, before it begins to act on the bullet, must fill the entire volume of the exit channel, which leads to a decrease in the gas pressure acting on the bullet and, accordingly, a decrease in the energy of the shot. This deficiency is described in detail in US 2021/0293509 in relation to the rifle disclosed in EP 3064884 A1.

The main valve 2 opens due to gas draining from the control chamber 5 to the atmosphere, which leads to unproductive gas consumption.

During operation of device-1, there is a moment when, as a result of pressing the trigger, the elongated piston 3 has already moved away from the seat 11 and gas is already coming out of the control chamber 5, and the main valve 2 has not yet opened. That is, the response time of the device increases.

US 2021/0293509 discloses a device for supplying compressed gas to an air rifle (hereinafter referred to as "device-2"), where the device includes a valve 9 and a valve tie including a front part in which the valve is fixed, an intermediate rod-shaped part and a final expanded part. The barrel 8, the valve tie 11, the valve 9 and the striker 14 are installed on the same axis, and the valve 9 connecting the pressure chamber 3 and the barrel 8, is controlled by the striker 14 through the valve tie 11. The pressure chamber 3 is connected to the barrel 8, and the bullet opening 29 of the barrel 8 is located at the entrance to the pressure chamber 3. The pressure chamber 3 and the barrel 8 are mutually locked by the valve 9, and, when firing, the pressure chamber 3 and the barrel 8 form a single space. The description states that thereby the valve mechanism has minimal or even zero space for expansion, and energy losses in the air rifle are minimal, and all the energy of the compressed gas is used for firing.

One of the disadvantages of this device will become clear when considering its operation.

Phase 1. The valve 9 is pressed against the valve seat 10. The diameter of the hole in the valve seat 10 (location 1) is slightly larger than the diameter of the rod 11 in the area of the sealing ring 27 (location 2). The pressure force on the tie 11 is equal to the product of the pressure in the pressure chamber 3 by the difference in the areas at location 1 and location 2 plus the pressure force on the tie 11 of the spring 12. The force acts towards the seat 10 and presses the valve 9 against it.

Phase 2. The valve 9 has completely moved away from the seat 10. The bullet begins its movement. The striker 14 has already abutted against the part 17 and does not act on the tie 11. The force of the spring 12 acts on the tie 11 again, and the pressure force on the tie 11 has changed its direction, now it acts towards the spring 12 and is equal to the product of the pressure in the pressure chamber 3 by the section area at location 2. As the bullet moves, the pressure in the pressure chamber 3 drops and the pressure force on the tie 11 decreases. Since the initial pressure force on the tie 11 is higher than the force of the spring 12 at maximum compression, the valve will begin to move towards the seat 10 only when the pressure force on the tie 11 drops below the compression force of the spring 12. In this case, the speed of the valve 9 will be reduced, since, in addition to the decreasing pressure force on the tie 11, the spring 12 will also be counteracted by the inertial force of the striker 14 and the spring 15; it does not fully release. During this slow closing of the valve, some amount of the gas will go into the barrel as losses, without participating in advancing the bullet.

Also, since the speed of the bullet (energy of the shot) is adjusted by the pressure in the pressure chamber 3, in order to optimize the gas flow when the pressure in the pressure chamber 3 changes, it is necessary to change the tension force of the spring 12.

The second disadvantage of the device-2 design is that it does not provide automatic cocking.

SUMMARY OF THE INVENTION

The subject invention provides a compressed gas supply device of an air rifle, providing simultaneously short response time, low gas consumption per shot and automatic cocking.

In the compressed gas supply device of the air rifle with an attachable source of compressed gas, comprising:

- a pressure chamber formed by a cylindrical body, a first end element and a second end element attached to it, wherein the first end element has an exit channel communicating with the rifle barrel;
- a valve and a tie, the tie including a front part, an intermediate part and an end part, wherein the valve and the tie are located on the same axis with the exit channel, and the edges of the first end element surrounding the entrance to the exit channel from the side of the pressure chamber form a valve seat;
- means for supplying compressed gas to the pressure chamber;
- a trigger mechanism, the front part of the tie comprises a valve spring, while the valve rests on the valve spring and is capable of moving forward and backward in relation to the tie, in the pressure chamber near the second end element there is a piston and a piston spring on which the piston rests, wherein the piston divides the pressure chamber into the front part located between the first end element and the piston, and the rear part located between the piston and the second end element, the piston being capable of moving forward and backward in relation to the second end element, the piston is made in the form of a cylindrical body and has a center hole.

Preferably, the front part of the tie is made in the form of a cylinder, the valve and the valve spring are located in the cylinder, the tie intermediate part has an end surface with which the piston may come into contact, the end part of the tie is made in the form of a rod, the center hole of the piston defines a port for the rod, the diameter of the center hole of the piston is larger than the diameter of the rod and the annular channel formed between the piston and the rod defines a bypass channel connecting the front part of the pressure chamber and the rear part of the pressure chamber.

Preferably, the cylinder has an end wall with a central hole, the valve has a first cylindrical part which has the diameter equal to the diameter of the central hole of the end wall, and a second cylindrical part which has the diameter equal to the inner diameter of the cylinder, the first cylindrical part of the valve can move out of the central hole until the second cylindrical part comes in contact with the end wall of the cylinder.

In an embodiment, the cylinder has the first bypass holes located near the end wall, and the second bypass holes located at a distance from the end wall.

In an embodiment, the first end element comprises a tie guide having a center hole and gas passages, wherein the cylinder is inserted into the center hole of the tie guide with the possibility of moving the tie forward and backward relative to the tie guide.

In an embodiment, on the side facing the second end member the piston has a cutout.

In an embodiment, the cutout extends from the bypass channel to the periphery of the piston.

Preferably, the device comprises a piston cylinder with a flange fixed on the cylindrical body, with the piston being located in the piston cylinder.

Preferably, the device comprises a pressure reducing valve by means of which the device is connected to a source of compressed gas.

Preferably, the device comprises a compensation chamber comprising a cylindrical body and an end element of the compensation chamber, wherein the cylindrical body is connected at its front end to the second end element, and the rear end is connected to the end element of the compensation chamber.

In an embodiment, the end element of the compensation chamber is the pressure reducing valve.

Preferably, at the front end the second end element has a central cylindrical cavity and an annular groove, wherein the second end element comprises a gas passage communicating with the annular groove, a port for the rod and a complex shaped cavity.

In an embodiment, in the central cylindrical cavity there is a sealing part having a port for the rod, connecting with the port for the rod in the second end element.

Preferably, the trigger mechanism comprises a sear, a trigger bar and a trigger lever, located in the complex shaped cavity of the second end element.

BRIEF DESCRIPTION OF THE DRAWINGS

The drawings show the arrangement of the device components in different phases of its operation in one cycle from shot to shot.

DESCRIPTION OF THE PREFERRED EMBODIMENT OF THE INVENTION

Figure 1:
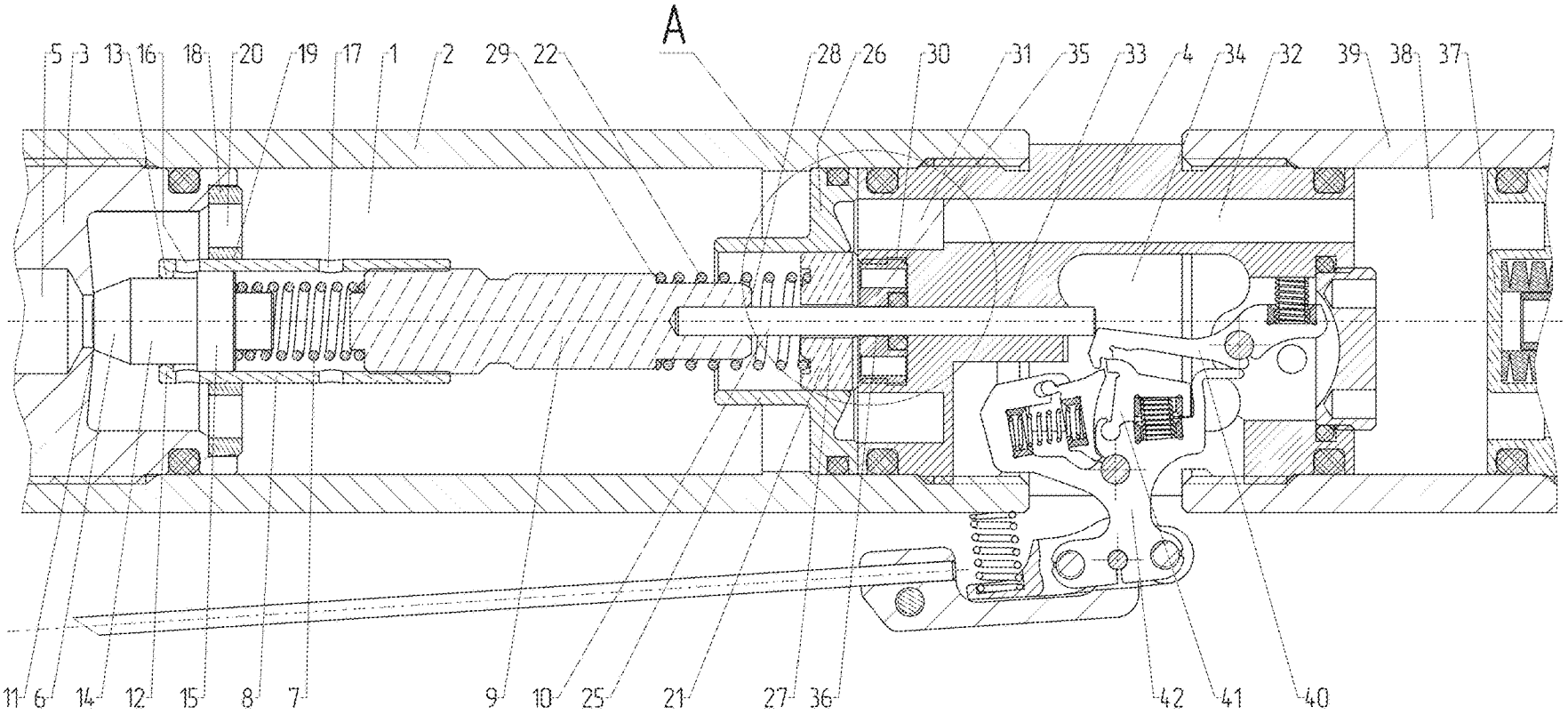
FIG. 1 shows the initial position: the valve is in contact with the valve seat, the rod abuts against the sear.

The device comprises the pressure chamber 1 formed by the cylindrical body 2, and the first end element 3 and the second end element 4 attached to it. The first end element 3 has the exit channel 5 communicating with the rifle barrel (not shown). The length of the exit channel does not exceed 25 mm. The device comprises the valve 6, the valve spring 7 and the tie. The tie comprises the front part in the form of the cylinder 8, the intermediate part 9 and the rear part in the form of the rod 10.

As used herein, the term "front" with respect to any element of the device means "facing the exit channel," and the term "rear" means "facing away from the exit channel". Similarly, "forward movement" means "movement in the direction of the exit channel" and "backward movement" means "movement in the direction away from the exit channel".

The exit channel 5 has a narrowed section, and the edges of the first end element 3, surrounding the entrance to the narrowed section of the exit channel 5 from the side of the pressure chamber 1, form the valve seat 11.

The cylinder 8 and the intermediate part 9 are connected by a threaded connection. The intermediate part 9 and the rod 10 may be formed as one piece, but in the preferred embodiment described here, the intermediate part 9 has a blind hole and the rod 10 is secured in this hole.

The valve 6 and the valve spring 7 are located in the cylinder 8. The valve spring 7 rests on the intermediate part 9, and the valve rests on the spring 7. The cylinder 8 has the end wall 12 with the central hole 13. The valve 6 has the first cylindrical part 14 having the diameter equal to the diameter the central hole 13 of the end wall 12, and the second cylindrical part 15 having the diameter equal to the inner diameter of the cylinder 8, while the first cylindrical part 14 of the valve can move out of the central hole 13 up to the second part 15 contact with the end wall 12 of the cylinder 8.

The cylinder 8 has the first bypass holes 16 located near the end wall 12, and the second bypass holes 17 located at a distance from the end wall 12.

The first end element 3 comprises the tie guide 18 with the central hole 19 and gas passages 20, while the cylinder 8 is inserted into the central hole 19 of the tie guide 18 with the ability of the tie forward movement and backward movement relative to the guide 18.

Figure 10:
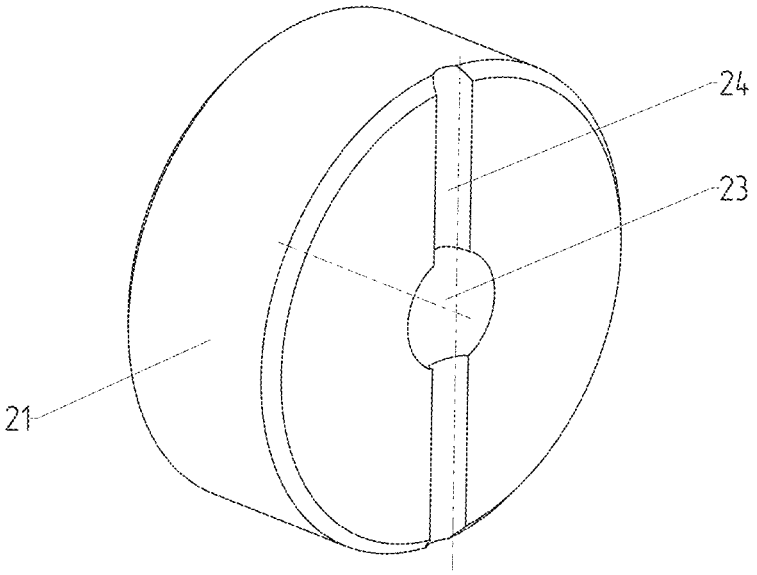
FIG. 10 is the enlarged view of the piston.

In the pressure chamber 1 there is the piston 21 and the piston spring 22. The piston 21 is made in the form of a cylindrical body and has the central hole 23 forming the port for the rod 10, and the cutout 24 on the rear end wall of the piston, connecting the central hole 23 and the peripheral cylindrical surface of the piston 21 (FIG. 10). The piston 21 and the part of the piston spring 22 are located in the piston cylinder 25. The piston cylinder 25 has the flange 26 by means of which it is fixed to the cylindrical body 2.

The piston 21 divides the pressure chamber 1 into the front part located between the first end element 3 and the piston 21, and the rear part located between the piston 21 and the second end element 4. The diameter of the central hole 23 in the piston 21 is larger than the diameter of the rod 10, and the annular channel formed between the piston (21) and the rod (10) defines a bypass channel (27) connecting the front part of the pressure chamber (1) and the rear part of the pressure chamber (1).

The tie intermediate part 9 has an end surface 28 and an abutting surface 29. The piston spring 22 rests on the abutting surface 29 of the intermediate part 9 and presses the piston 21 against the second end element 4. The piston 21 is capable of moving forward and backward in relation to the second end element 4 and interacting with the end surface 28 of the intermediate part 9.

The second end element 4 is made in the form of a cylindrical body with a flat front surface. The rear surface of the second end element may also be flat, but may have a different shape. At the front end, the second end element 4 has the central cylindrical cavity 30 and the annual groove 31 located concentrically with it. The second end element 4 comprises the gas passage 32 communicating with the annular groove 31, the port 33 for the rod 10 and the complex shaped cavity 34 for receiving the trigger mechanism parts. In the central cylindrical cavity 30 there is the sealing part 35 with the port 36 for the rod 10, connecting with the port 33 for the rod 10 in the second end element 4.

The rod 10 passes through the central hole 23 of the piston 21, the port 36 in the sealing part 35, the port 33 in the second end element 4 into the complex shaped cavity 34 in the second end element 4.

The device comprises the pressure reducing valve 37 by means of which it is connected to the source of compressed gas. The device comprises the compensation chamber 38 comprising the cylindrical body 39 which is connected at the front end to the second end element 4, and at the rear end the cylindrical body 39 is connected to the end element of a compensation chamber, which in the described embodiment is the pressure reducing valve 37. Modifications are possible when the end element of the compensation chamber is not the pressure reducing valve 37, but the wall in which the pressure reducing valve 37 is fixed, or the wall that communicates with the pressure reducing valve 37 through a pipeline.

The compensation chamber 38, the gas passage 32 and the annular groove 31 form the means for passing gas from the compressed gas source into the pressure chamber 1.

The device modification without a compensation chamber is possible, when the pressure chamber 1 communicates with the compressed gas source only through a suitable channel for supplying gas. But this modification requires the use of high-capacity pressure reducing valves which are lower-precision and significantly more expensive.

In the complex shaped cavity 34 there is the sear 40, the trigger bar 41 and the trigger lever 42 of the trigger mechanism. The end of the rod 10 interacts with the sear 40. The trigger lever 42 is connected to the rifle trigger by ties (one of them extending from the trigger lever 42 is shown). When the trigger is pressed to fire, the trigger lever 42 moves in the opposite direction from the trigger.

The operating phases of the device are described below.

Phase 1. Before the shot, the bullet is in a drum chamber (not shown) of the revolving mechanism which at one end communicates with the rifle barrel, and at the other end it communicates with the exit channel 5. Another type of a magazine can be used to supply bullets. A reservoir with compressed gas is connected to the pressure reducing valve 37 (not shown) by means of which the operating pressure of the compressed gas in the device is set. The operating pressure can be from 80 to 200 atm.

All cavities in the front part of the pressure chamber 1 are filled with gas (up to the piston 21), including the cavity limited by the cylindrical body 2, the cavity of the first end element 3, the cavity of the piston cylinder 25, gas passages 20 in the tie guide 18 and all cavities in the tie cylinder 8. In the rear part of the pressure chamber 1 (behind the piston 21), gas is present only in space 43 (it will be discussed further) between the piston 21 and the sealing part 35 and in the cutout 24 in the end wall of the piston. Outside the pressure chamber 1 the cutout in the piston cylinder flange 26 (its purpose is to reduce the mass of the flange), the annular groove 31, the gas passage 32 and the compensation chamber 38 are filled with gas. Due to the bypass channel 27, gas pressure in the front part of the pressure chamber 1 and in the rear part of the pressure chamber 1, as well as in all cavities outside the pressure chamber 1, including in the compensation chamber 38, is the same.

Figure 9:
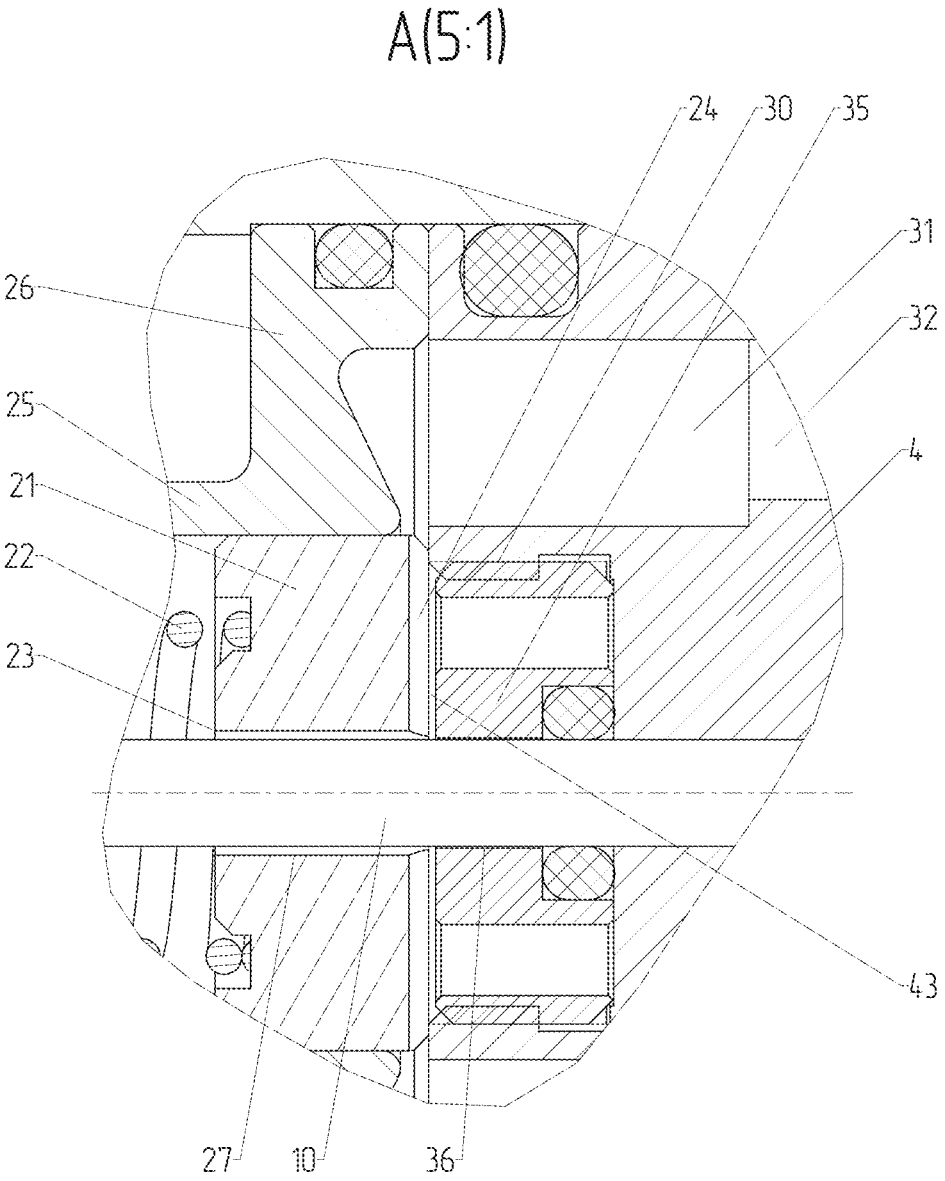
FIG. 9 is the enlarged view of the place where the pressure chamber is connected to the compressed gas supply means.

FIG. 1 shows the position of the device components before firing. The valve spring 7 presses the valve 6 to the valve seat 11, and the piston spring 22 presses the piston 21 to the second end element 4, wherein only the peripheral part of the end surface of the piston 21 is in contact with the second end element, and between the rest of the end surface of the piston 21 and the sealing part 35 space 43 is formed (FIG. 9), since the sealing part is located in the central cylindrical cavity 30 so that its end surface is slightly offset relative to the end surface of the second end element 4. The end of the rod 10 abuts against the front side of the sear 40. At this moment, the sear 40 is in its upper position in which the tooth of the trigger bar 41 is in the lower recess of the sear 40.

Figure 2:
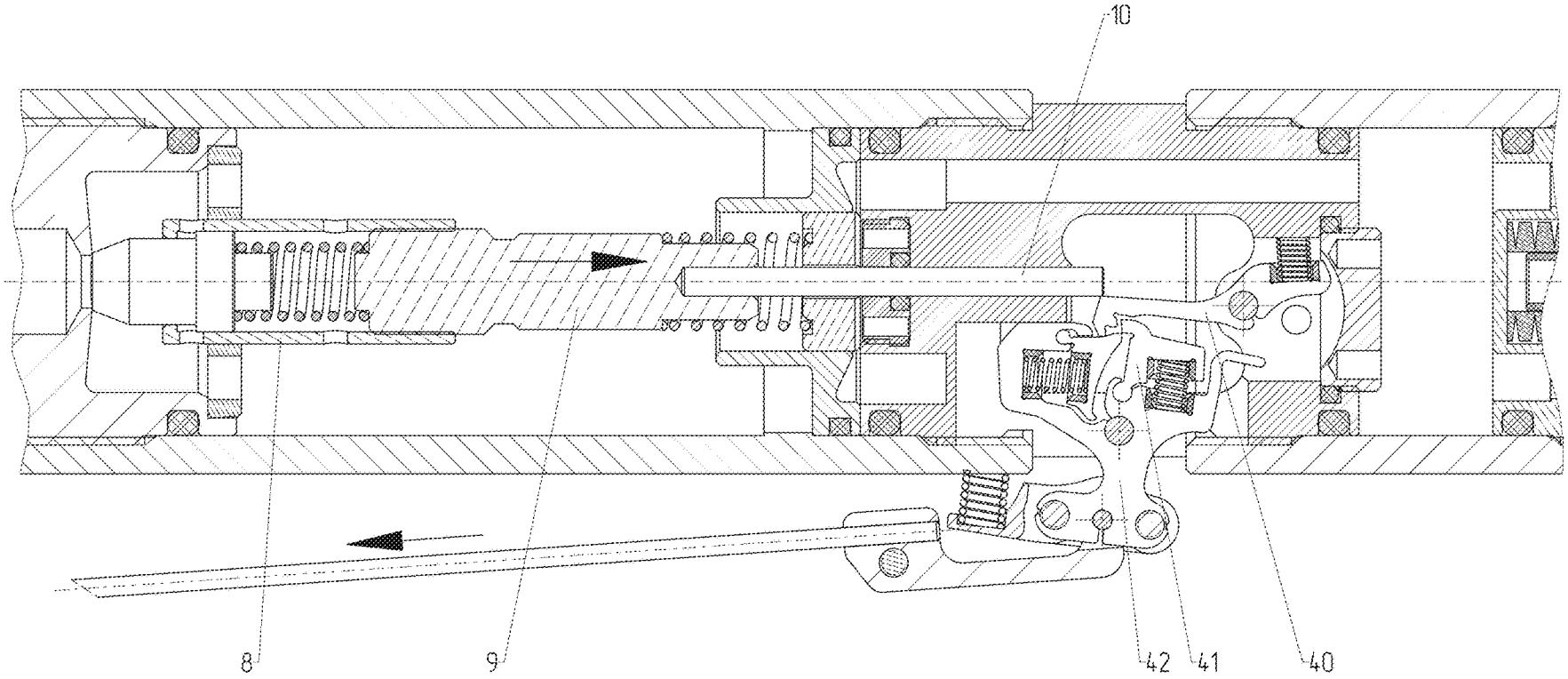
FIG. 2 shows the first moment after pressing the trigger, the sear is unlocked, the tie begins to move backward.

Phase 2. FIG. 2 shows the position of the components at the moment after the trigger is pressed. The lower end of the trigger lever 42, connected through a tie system to the trigger, moves in the direction of the arrow. The tooth of the trigger bar 41 comes out of the lower recess of the sear 40 and the latter moves to its lower position at which the tie rod 10 no longer abuts against the front surface of the sear 40, the latter is unlocked. Under the influence of gas pressure acting on the tie, the tie begins to move backward (shown by the arrow). All other components remain in their previous position.

Figure 3:
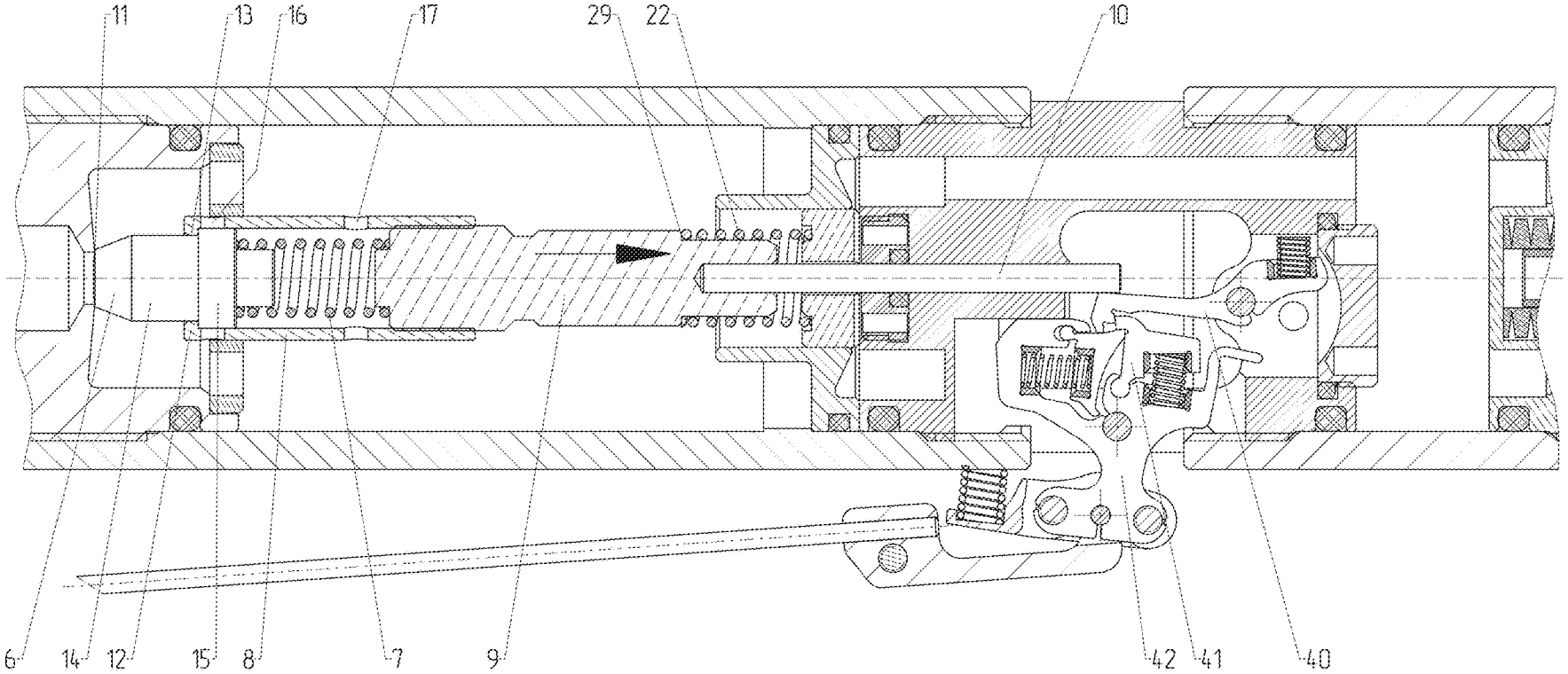
FIG. 3 is the continuation of the backward movement of the tie.

Phase 3. The tie continues its backward movement. The rod 10 slides along the top side of the sear 40. The cylinder 8 moves backward along with the rest of the tie. The valve spring 7 releases and the valve 6 moves out of the cylinder 8 through the hole 13 in the cylinder end wall 12. The gas located in the cavities of the cylinder 8 does not interfere with the movement of the valve 6 in the cylinder 8, since the gas exits through the first bypass holes 16 and the second bypass holes 17. Moving the valve 6 out of the cylinder 8 stops at the moment when the second cylindrical part 15 of the valve abuts against the end wall 12 of the cylinder 8 (this moment is shown in FIG. 3). The valve 6 still remains in contact with the valve seat 11. Since the piston spring 22 rests on the abutting surface 29 of the tie intermediate part 9, the piston spring 22 is compressed when the tie moves backward.

Figure 4:
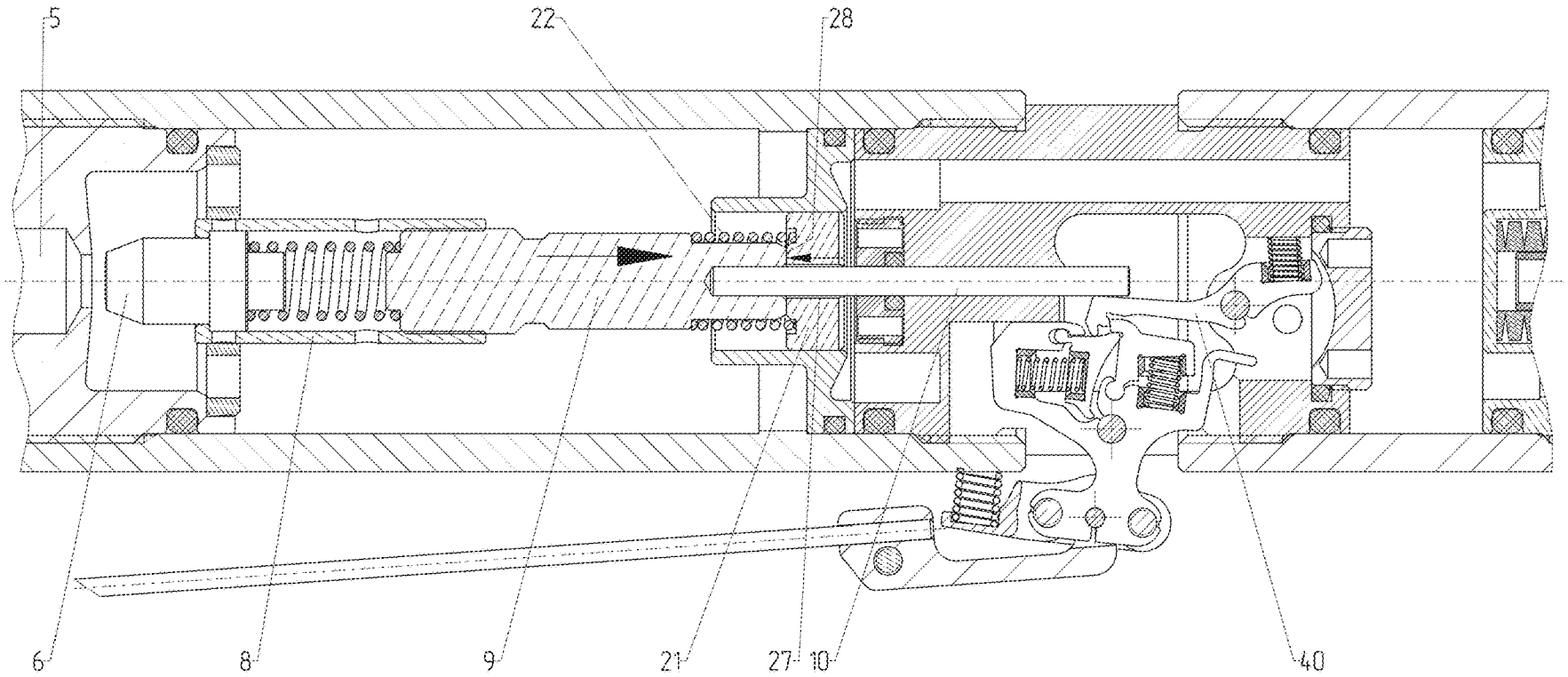
FIG. 4 is the moment of firing: the tie has reached its rearmost position, the valve has completely moved away from the seat and the compressed gas streams into the exit channel.

Phase 4. The tie continues to move backward by inertia, dragging the valve 6 captured by the cylinder end wall 12. FIG. 4 shows the moment when the tie, including the rod 10, is in its rearmost position. The sear 40 is in its lowest position and the rod 10 is in contact with its upper side. The valve 6 has moved as far as possible from the seat 11, the valve spring 7 is released as much as possible, and the piston spring 22 has compressed as much as possible, and the end surface 28 of the tie intermediate part 9 has come into contact with the piston 21. A shot occurs in which gas comes out of the front part (in front of the piston 21) of the pressure chamber 1 and, having passed the short exit channel 5, begins to push the bullet located in the drum chamber into the barrel and further pushes it along the barrel until it departs the barrel.

From the moment the valve 6 leaves the valve seat 11, the gas pressure in the front part (in front of the piston 21) of the pressure chamber 1 drops abruptly, the cross-section of the bypass channel 27 does not allow to quickly restore gas pressure to its level in the rear part (behind the piston 21) of the pressure chamber 1, which is equal to the pressure in the compensation chamber 38, and the piston 21, immediately after the valve 6 moves away from the seat 11, begins to move forward (shown by the arrow) from the end wall of the second end element 4 to which it was pressed. The automatic cocking process begins.

Figure 5:
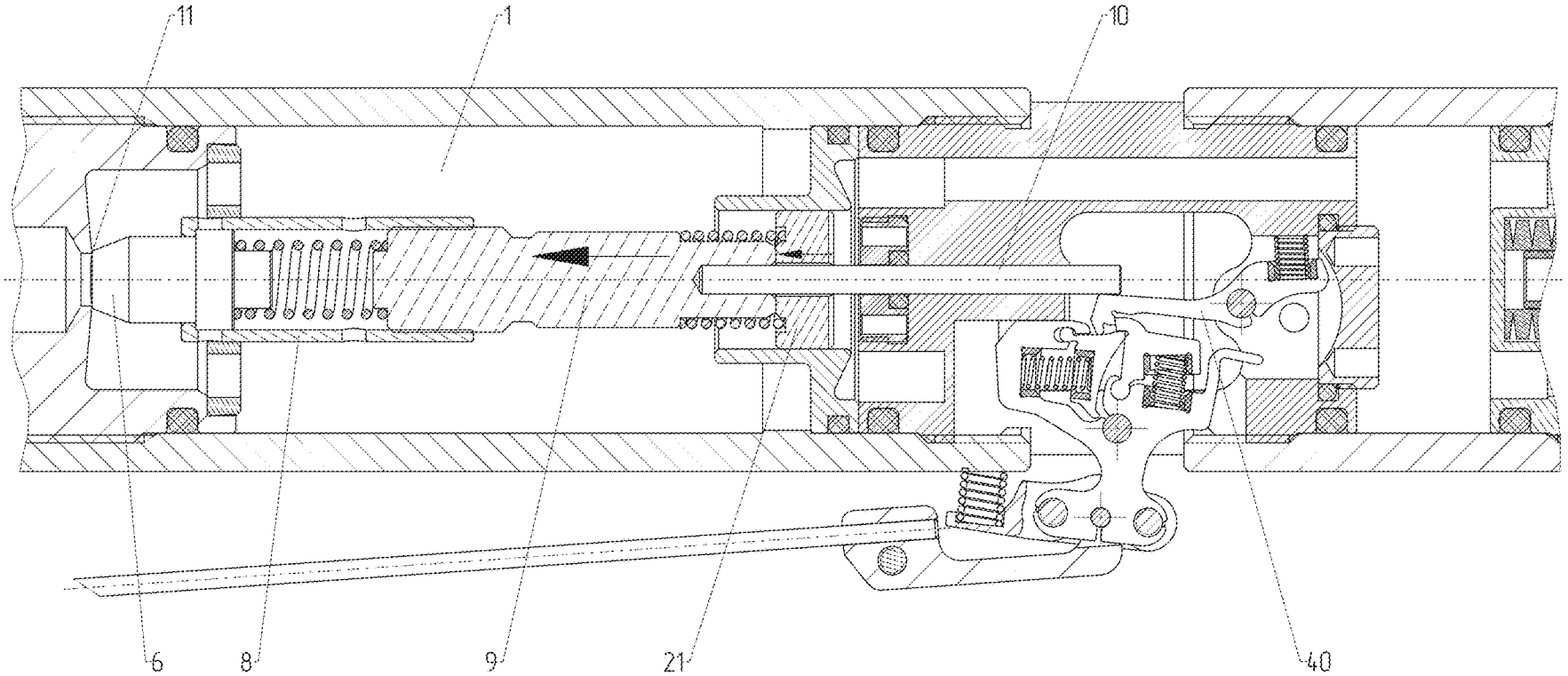
FIG. 5 shows that the tie has changed the direction of movement and due to the tie forward movement the valve has again come into contact with the seat.

Phase 5. FIG. 5 shows the moment when the piston 21, due to forward movement under gas pressure, has moved the tie forward insomuch that the valve 6, moved as far as possible out of the cylinder 8, has again come into contact with the seat 11 and blocked supplying the gas from the pressure chamber 1 into the exit channel 5. At this moment, the bullet is moving in the beginning (¼-⅓) of the barrel. In this case, the pressure in the front part of the pressure chamber 1 dropped by approximately 20%. The sear 40 is still in its lowest position and the rod 10 slides along its upper side. As a result of moving the piston 21 forward and increasing the space 43 communicating with the compensation chamber 38, the gas pressure in the compensation chamber 38 drops and the pressure reducing valve 37 is activated, restoring the gas pressure in the compensation chamber 38 to the predetermined level by supplying gas from the compressed gas source.

Figure 6:
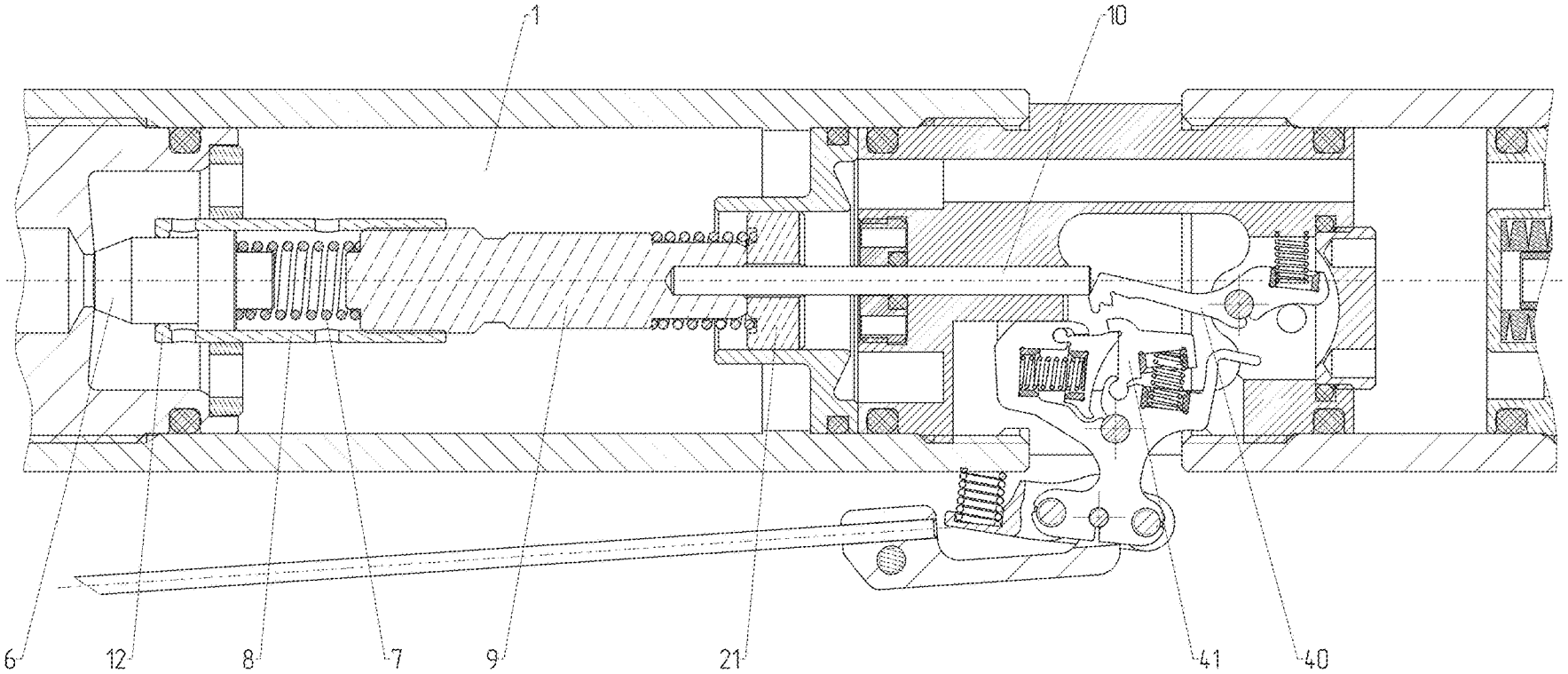
FIG. 6 shows that the tie has reached its full forward position, the sear has risen to its highest position and the tie rod has again come into contact with the front side of the sear.
Figure 7:
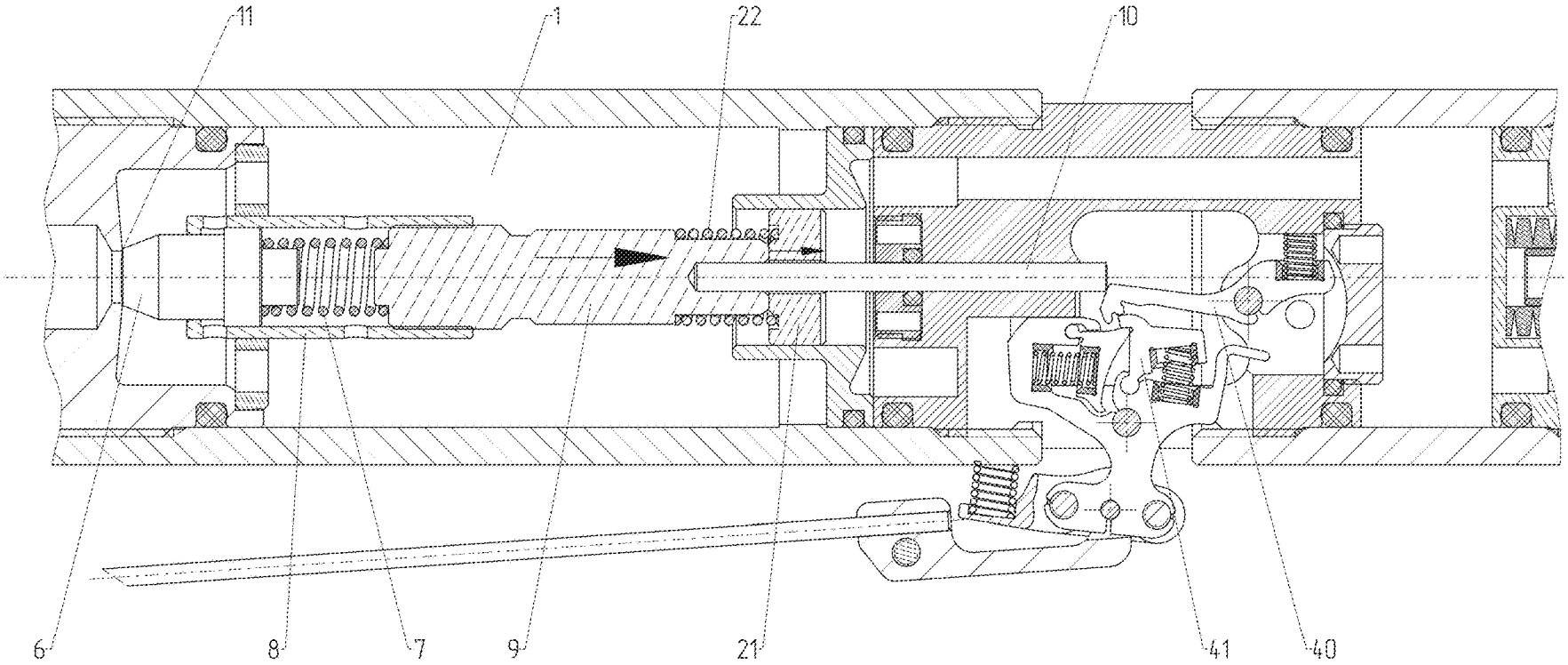
FIG. 7 shows that the tie continues to move backward and the tie rod moves the sear to the lower position.
Figure 8:
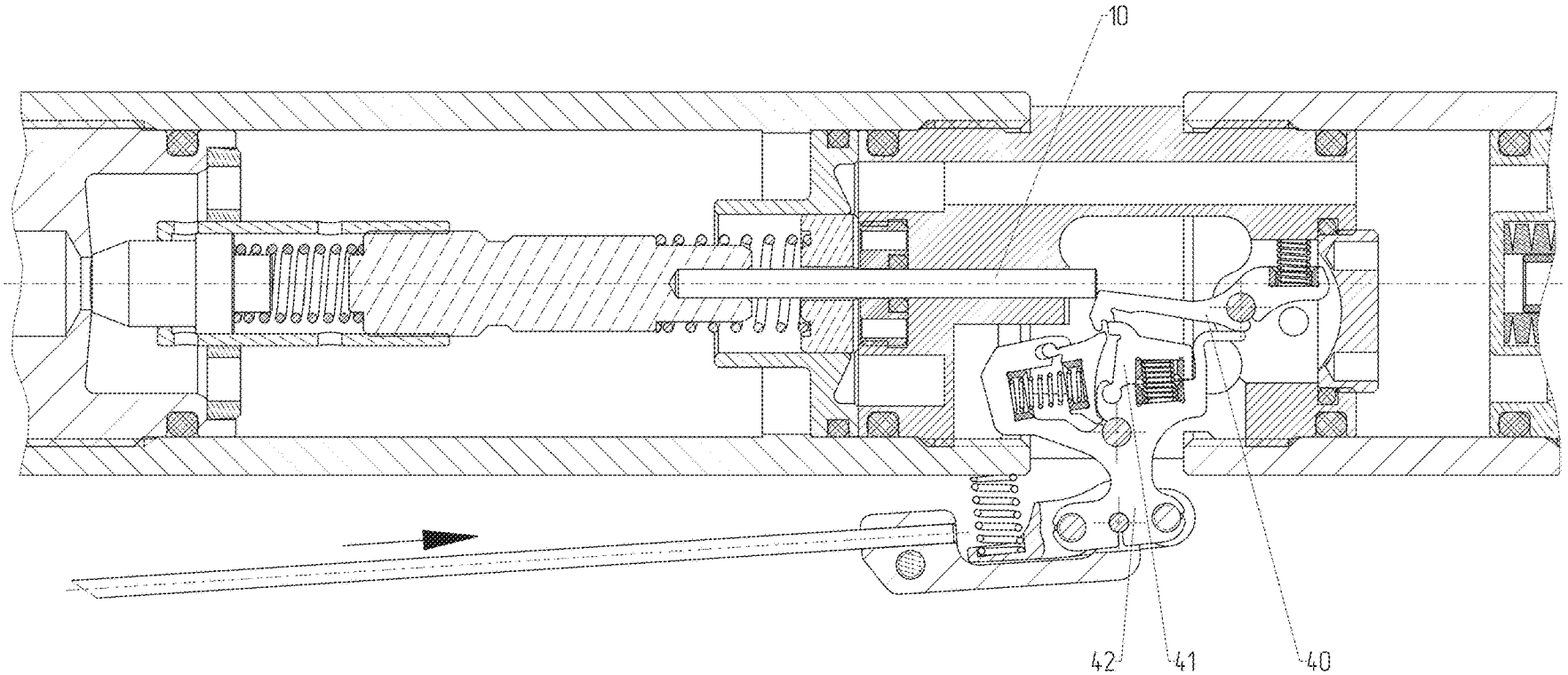
FIG. 8 illustrates that the cocking of the tie with the valve has been completed under the influence of the trigger lever.

Phase 6. FIG. 6 shows the moment when the piston 21 and, accordingly, the tie that it pushed forward, reached its full forward position. The cylinder 8 is pushed onto the valve 6 abutting against the seat 11 and the second cylindrical part 15 of the valve 6 moves away from the end wall 12 of the cylinder 8. The valve 6 compresses the spring 7. The rod 10 has released the sear 40, the latter has risen to its highest position, when it does not interact with trigger bar 41, and the rod 10 is again in contact with the front side of the sear 40.

Phase 7. The pressure in the front part of the pressure chamber 1 is almost equal to the pressure in the rear part of the pressure chamber 1, and the forces moving the tie backward again began to act on the tie. With the tie movement backward, the piston 21 against which the end surface 28 of the intermediate part 9 abuts, moves backward together with it, and the piston spring 22 releases. Gas flows from the rear part of the pressure chamber 1 to the front part of the pressure chamber 1. The valve spring 7 also releases, but the valve 6 remains pressed against the seat 11. The end of the rod 10 puts pressure on the front side of the sear and, since the front side is located at an angle, the rod 10 causes the sear 40 to tilt down and engage with the trigger bar 41.

Phase 8. The shooter releases the pressure on the trigger and, under the influence of the ties and springs of the trigger mechanism, the trigger lever 42 moves in the direction of the arrow, and the tooth of the trigger bar 41 enters the lower recess of the sear 40. The tie with the valve is cocked. All components of the device have returned to their initial position shown in FIG. 1. The pressure reducing valve 37 restored the working pressure of compressed gas in the device. The device is ready for the next cycle.

The device according to the invention provides the response time of about 1 ms, that improves shooting accuracy. Gas consumption is about 9 $cm^3$/J with the rifle caliber of .25, bullet weight of 2.2 g and its energy of 92.5 J, which increases the efficiency of the rifle. Automatic cocking is provided, which increases the ease of the rifle use, since no additional actions are required from the shooter.

We claim:

1. A compressed gas supply device of an air rifle with an attachable source of compressed gas, comprising:

a pressure chamber formed by a cylindrical body, a first end element and a second end element attached to it, wherein the first end element has an exit channel communicating with the rifle barrel;

a valve and a tie, the tie including a front part, an intermediate part and an end part, wherein the valve and the tie are located on the same axis with the exit channel, and the edges of the first end element surrounding the entrance to the exit channel from the side of the pressure chamber form a valve seat;

means for supplying compressed gas to the pressure chamber;

a trigger mechanism, characterized in that the front part of the tie comprises a valve spring (7), while the valve (6) rests on the valve spring (7) and is moveable forward and backward in relation to the tie, in the pressure chamber (1) near the second end element (4) there is a piston (21) and a piston spring (22) on which the piston (21) rests, wherein the piston (21) divides the pressure chamber (1) into a front part located between the first end element (3) and the piston (21), and a rear part located between the piston (21) and the second end element (4), the piston (21) being moveable forward and backward in relation to the second end element (4), the piston (21) is made in the form of a cylindrical body and has a center hole (23).

2. The device according to claim 1, characterized in that the front part of the tie is made in the form of a cylinder (8), the valve (6) and the valve spring (7) are located in the cylinder (8), the tie intermediate part (9) has an end surface (28) with which the piston (21) can come into contact, the end part of the tie is made in the form of a rod (10), the center hole (23) of the piston (31) defines a port for the rod (10), a diameter of the center hole (23) of the piston (21) is larger than a diameter of the rod (10), and an annular channel formed between the piston (21) and the rod (10) defines a bypass channel (27) connecting the front part of the pressure chamber (1) and the rear part of the pressure chamber (1).

3. The device according to claim 2, characterized in that the cylinder (8) has an end wall (12) with a central hole (13), the valve (6) has a first cylindrical part (14) that has a diameter equal to the diameter of the central hole (13) of the end wall (12), and a second cylindrical part (15) that has a diameter equal to an inner diameter of the cylinder (8), the first cylindrical part (14) of the valve can move out of the central hole (13) until the second cylindrical part (15) comes in contact with the end wall (12) of the cylinder (8).

4. The device according to claim 3, characterized in that the cylinder (8) has first bypass holes (16) located near the end wall (12), and second bypass holes (17) located at a distance from the end wall (12).

5. The device according to claim 1, characterized in that the first end element (3) comprises a tie guide (18) having a center hole (19) and gas passages (20), wherein the cylinder (8) is inserted into the center hole (19) of the tie guide (18) with the ability to move the tie forward and backward relative to the tie guide (18).

6. The device according to claim 1, characterized in that on a side facing the second end element (4), the piston (21) has a cutout (24).

7. The device according to claim 6, characterized in that the cutout (24) extends from the bypass channel (27) to a periphery of the piston (21).

8. The device according to claim 1, comprising a piston cylinder (25) with a flange (26) fixed on the cylindrical body (2), with the piston (21) being located in the piston cylinder (25).

9. The device according to claim 1, comprising a pressure reducing valve (37) by means of which the device is connected to the source of compressed gas.

10. The device according to claim 1, comprising a compensation chamber (38) comprising a cylindrical body (39) and an end element of the compensation chamber, wherein the cylindrical body (39) is connected at a front end to the second end element (4), and at a rear end is connected to the end element of the compensation chamber (38).

11. The device according to claim 10, characterized in that the end element of the compensation chamber is a pressure reducing valve (37).

12. The device according to claim 1, characterized in that at a front end the second end element (4) has a central cylindrical cavity (30) and an annular groove (31), wherein the second end element (4) comprises a gas passage (32) communicating with the annular groove (31), a first port (33) for a rod (10) and a complex shaped cavity (34).

13. The device according to claim 12, characterized in that in the central cylindrical cavity (30) there is a sealing part (35) having a second port (36) for the rod (10), connecting with the first port (33) for the rod (10) in the second end element (4).

14. The device according to claim 1, characterized in that the trigger mechanism comprises a sear (40), a trigger bar (41) and a trigger lever (42), located in a complex shaped cavity (34) of the second end element (4).

* * * * *